United States Patent [19]

Fulton

[11] 4,265,706

[45] May 5, 1981

[54] DRAINAGE DEVICE WITH BONDED WEAR SURFACE AND METHOD OF FABRICATION

[75] Inventor: William M. Fulton, Wellesley, Mass.

[73] Assignee: Albany International Corp., Menands, N.Y.

[21] Appl. No.: 957,134

[22] Filed: Nov. 2, 1978

[51] Int. Cl.[3] ..... D21F 7/00

[52] U.S. Cl. ..... 162/352; 162/374

[58] Field of Search ..... 162/352, 374; 428/45, 428/49

[56] References Cited

U.S. PATENT DOCUMENTS

| | | | |
|---|---|---|---|
| 3,067,816 | 12/1962 | Gould | 162/374 |
| 3,250,671 | 5/1966 | Walker | 162/374 |
| 3,351,524 | 11/1967 | Duncan | 162/374 |
| 3,393,124 | 7/1968 | Klingler et al. | 162/352 |
| 3,446,702 | 5/1969 | Buchanan | 162/374 |
| 4,004,969 | 1/1977 | Beauchemin | 162/352 |

FOREIGN PATENT DOCUMENTS

| | | | |
|---|---|---|---|
| 772393 | 11/1967 | Canada | 162/374 |
| 1403158 | 8/1975 | United Kingdom . | |

*Primary Examiner*—Peter Chin

[57] ABSTRACT

A drainage device adapted to be mounted on a paper-making machine and positioned to support the moving web and to engage the undersurface of the web as it passes thereover to extract fluid downwardly from the web. The drainage device includes a main body portion and a multiplicity of wear resistant wafers bonded thereto with the upper surface of the wafers providing a bearing surface for the moving web as it passes thereover and the main body portion and the wafers having substantially the same coefficient of thermal expansion.

4 Claims, 9 Drawing Figures

FIG. 6
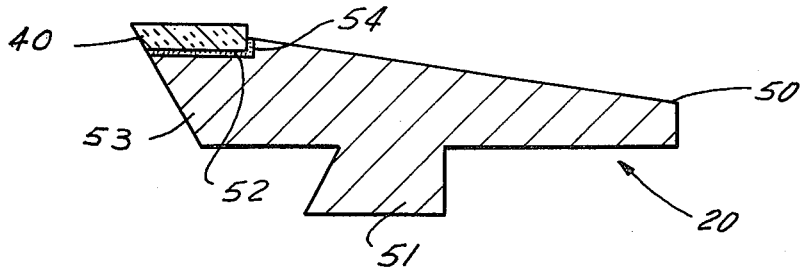
FIG. 7
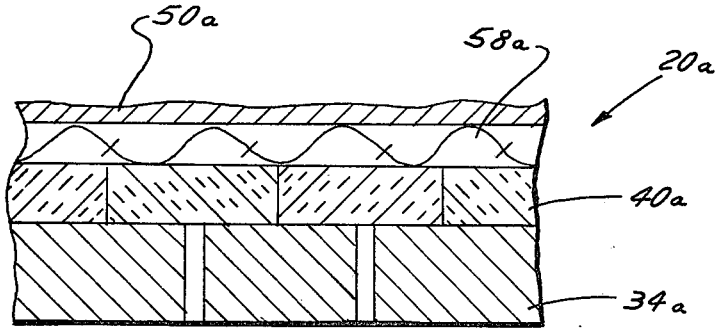
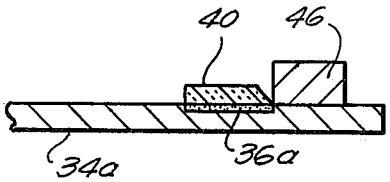
FIG. 8
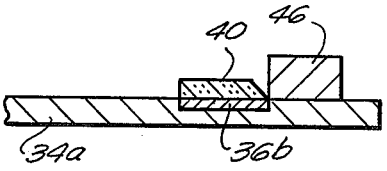
FIG. 9

DRAINAGE DEVICE WITH BONDED WEAR SURFACE AND METHOD OF FABRICATION

BACKGROUND OF THE INVENTION

In the development of the traditional type of papermaking machine known as a Fourdrinier machine, a moving endless wire carrying paper stock is passed over a series of conditioning stations which have been subjected to a variety of improvements throughout the years to make the papermaking process more efficient, inexpensive and generally improved. The moving wire encounters two major areas for conditioning the wet material carried by it. First the wire passes over a series of rollers, stationary foils or doctor blades and second over a series of suction boxes. At both stations, the general objective is to remove water or other fluid from the paper stock, in other words drainage of water therefrom. Suction can also be applied at the location of the stationary foils or rollers as well as at the suction box station.

The general trend has been toward the use of a stationary doctor blade or drainage foil rather than rollers and various improvements in that type of structure have appeared through the years. The improvements have been primarily in changes in configuration for the foil, replacement portions for the foil and means for mounting and replacing the foil, as well as the provision of improved wear surfaces for engagement with the moving foil of the papermaking machine. These criteria have been found to be of great importance in this type of structure since the forming wire moves at a very high rate of speed.

Also, this wire with the wet sheet of stock material is quite heavy and the stationary foil must support this weighted moving wire as water is doctored or drained from the wire.

The surface of the foil in engagement with the moving wire is subjected to high wear conditions and must be replaced frequently. Thus, ease of replacement is important and improvements in this area have been made so that the machine will be out of operation for the minimum possible time while foils are being replaced. Additionally, different types of wear surfaces which are harder and subject to less deteriation due to wear over longer periods of time have been developed. Due to economic considerations and replacement considerations, these harder surfaces are often formed as part of the foil, the part in direct contact with the moving wire.

After the moving wire and transported paper stock material passes the location of the stationary foil or rolls, it comes into contact with a series of suction boxes which further draw water from the paper stock or substrate on the moving wire. The suction boxes are arranged so that they have an upper wear surface with apertures therein. The wire passes over and is supported by the upper wear surface of the suction box while vacuum draws water through the apertures in the suction box cover. Thus, in general, the wear criteria dealing with the nature of the surface of the stationary foil which is in contact with the moving wire is also applicable to the suction box cover or surface which is in similar direct engagement with the moving wire. Similar developments in attempting to improve wear surface have occured in regard to suction box covers and so called forming surfaces as shown in British Pat. No. 1,403,158.

One area of development in regard to improving the wear surface of the stationary drainage foils and the suction box covers deals with the use of a ceramic wear surface which has a number of the desired characteristics for the surface as discussed above. Three developments relating to suction box covers which specifically discuss the use of ceramics are U.S. Pat. Nos. 3,067,816; 3,250,671; and 3,351,524.

A serious difficulty that arises when dealing with ceramics is that manufacture of ceramics in large sections creates cost problems in respect to both manufacture and installation. Furthermore, in the past, attempts at development of ceramic wear surfaces of smaller component parts or smaller ceramic pieces mounted in some fashion together with remaining structures have resulted in increased manufacturing and installation costs as well as difficulties in operation. This is particularly true in respect to the tendency of one or more of the smaller ceramic components to be displaced or disoriented with respect to the others during fabrication of the drainage device or in use of the drainage device. This is a problem particularly where the high speed and heavy wire is being continuously passed over the surface such as in the common type of Fourdrinier papermaking machine.

Accordingly, in the continuous development of improved drainage devices such as foils and suction box covers there is still room for improvement in order to satisfy all of the desired criteria for that type of structure when dealing with papermaking machinery and other similar types of machinery.

SUMMARY OF THE INVENTION

With the above background in mind, it is among the primarily objectives of the present invention to provide an improved drainage device and method of fabricating the same which is particularly useful in a papermaking machine. The drainage device can be manufactured at a minimum cost and readily and effeciently installed and replaced at low cost while retaining the benefits of a high quality hard ceramic wear surface for engagement with the moving wire. The drainage device is designed so that it provides an efficient wear surface which is adapted for maximum wear resistance without detracting from speed and effective movement of the moving wire while supporting the wire and subjecting the wire to doctoring or drainage of water or other fluid therefrom. Additionally, the design lends itself to application of suction to cooperate with the doctoring action of the wear surface in assisting in removing water or other fluid from the substrate on the moving endless wire. The drainage device is formed of a minimum number of components which are of inexpensive material and are inexpensively and easily assembled to produce an ultimate component that can be easily and quickly installed and replaced. The device is highly wear resistant while being subjected to normal wear conditions.

In summary, it is among the primary objectives of the present invention to develop a drainage device utilizing a multiplicity of wear resistant wafers which can be inexpensively manufactured. The device is formed by unique methods of combining the wafers with other elements to provide a device which will be rigid and strong for use as an effective wear surface for both load deflection purposes due to the weight of the moving wire with wet paper stock thereon and the doctoring action of fluid therefrom. The improved method results in an improved product which has a wear surface formed of a multiplicity of small, thin, rectangularly shaped wear resistant wafers.

More specifically, as a foil the drainage device is formed of a main body portion and a multiplicity of wear resistant wafers affixed to the main body portion with the upper surface of the wafers forming a wear surface and a bearing surface for doctoring fluid from the moving wire of a Fourdrinier papermaking machine as it passes thereover. The resulting drainage foil is adapted to be positioned beneath and in engagement with the supporting wire at a location just prior to the location of the suction box arrangement with respect to the direction of movement of the endless belt to both support the forming wire and engage the undersurface of the forming wire for doctoring or extracting fluid downwardly therefrom.

The drainage foil is formed by arranging a multiplicity of wear resistant wafers on a base plate, metering a predetermined amount of bonding material on th exposed surface of the multiplicity of wear resistant wafers opposite to the base plate, and positioning the main body portion of the foil on the multiplicity of wafers in engagement with the bonding material thereby forming the drainage foil with the main body portion bonded to the multiplicity of wafers. As a preferred embodiment of the invention it is desired that the coefficient of thermal expansion of wafers and main body portion should not be greatly different.

Although the wear surface structure and its method of formation are discussed herein in terms primarily of a drainage foil it is equally applicable in formation of other types of similar drainage devices such as suction box covers which serve to drain wires in the Fourdrinier section or felts in the press section of the papermaking machine.

With the above objectives among others in mind, reference is made to the attached drawings.

BRIEF DESCRIPTION OF THE DRAWINGS

In the Drawings:

FIG. 6 is a sectional elevation view of a foil of the invention;

FIG. 7 is a fragmentary sectional elevation view of an alternative form of a foil of the invention;

FIG. 8 is a fragmentary view of an alternate method of fabrication with the wafers held in position by an adhesive during such fabrication; and FIG. 9 is a fragmentary view of another method of fabrication with the wafers held in position by a magnet during fabrication.

DETAILED DESCRIPTION

Figure 1:
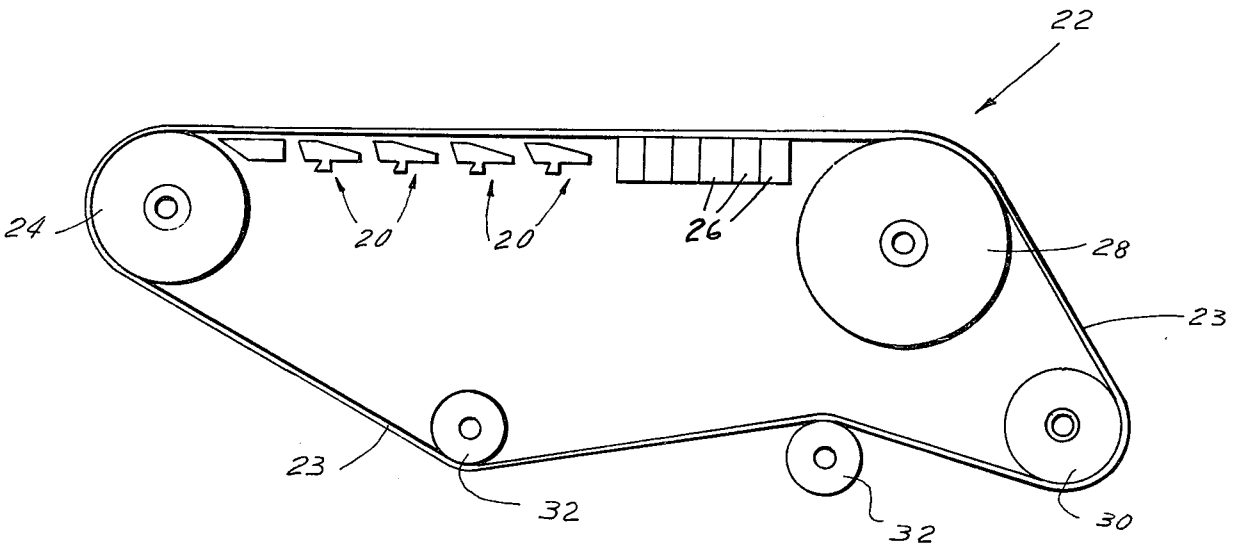
FIG. 1 is a schematic view of the endless wire arrangement for a Fourdrinier type papermaking machine with a group of foils constructed in accordance with the present invention incorporated therein.

Drainage foils 20 are shown in FIG. 1 as part of a typical Fourdrinier papermaking machine system. The portion of the papermaking machine which is depicted includes a Fourdrinier wire 23 in the form of an endless belt. The wire passes around a breast roll 24. Thereafter a substrate of wet stock paper material is positioned on the porous wire 23. The wire then passes into engagement with the supporting surface of drainage foils 20 which doctor or draw water from the wire. The suction boxes 26 thereafter assist in drawing water from the wire.

The suction boxes 26 have suction box covers acting as supports for the wire and contain apertures for suction to draw additional moisture from the stock contained on the wire 23. The drained stock passes around a couch roll 28 and is removed thereafter from the wire as the direction of the wire is changed downward until it engages and passes around a forward driving roll 30 which is attached to an appropriate drive source to advance the endless wire 23. The direction is thus changed so that the wire then passes over an arrangement of return rolls 32 until it again comes into contact with the breast roll 24 for return to the upper working surface of the Fourdrinier papermaking machine for deposit of a new supply of substrate.

Figure 2:
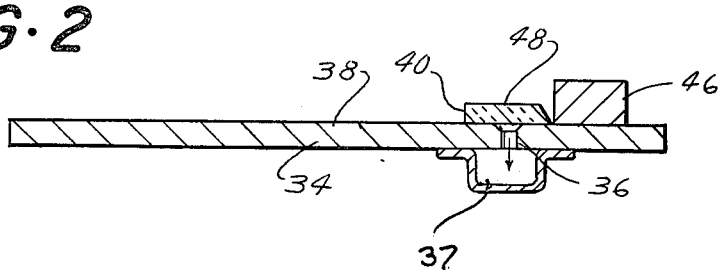
FIGS. 2–4 is a sequence of sectional views showing the steps of manufacturing the foil of the invention.
Figure 3:
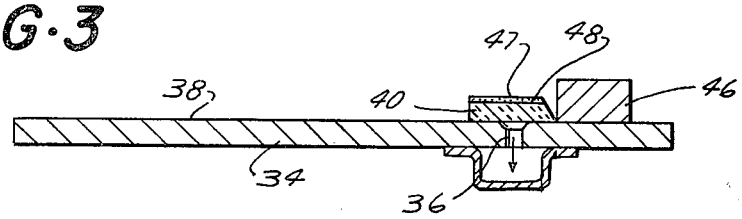
Figure 4:
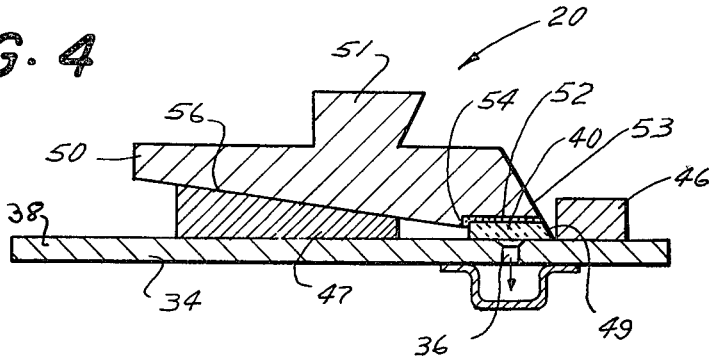

Turning to consideration of construction of the drainage foils 20, reference is made to FIGS. 2–4.

Initially as shown in FIG. 2, a level or horizontal base plate 34 forms a working surface for formation for the foil. The base plate 34 has a plurality of spaced holes 36 therethrough so that when the plate is attached to a source of suction (not shown), as indicated by the arrow in FIG. 2, the suction applied through the vacuum chamber 37 and communicating apertures 36 will tend to hold items placed on the upper surface 38. Other means to hold items upon surface 38 may be employed. Several specific alternate forms are shown in the FIGS. and described below. The vacuum chamber 37 is provided by a flanged channel mounted on the underside of the base plate in a conventional fashion such as by welding.

Figure 5:
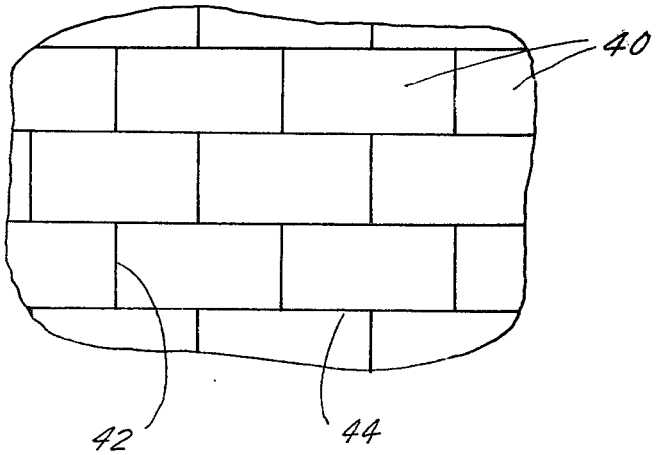
FIG. 5 is a fragmentary top plan view of the wear surface thereof.

With the suction applied in a conventional manner to the horizontal base plate 34, a multiplicity of wafers 40 of wear resistant material such as ceramic are placed in rows in side by side relationship on the upper surface 38 of base plate 34. The suction applied through openings 36 tends to hold the wafers 40 in the pattern in which they are arranged. In the particular example illustrated in FIG. 5, the rectangular shaped wafers 40 are arranged end to end in rows and side by side with adjacent wafers offset with respect to one another so that the join lines 42 of the wafers are offset, although this offset may not be used in all applications. The rows are arranged parallel so that the adjoining elongated longitudinal edges 44 are parallel to one another as depicted in FIG. 5. Alternatively, a single row of wafers 40 can be arranged end to end instead of an arrangement of two or more parallel rows.

The number of rows of wafers is a matter of choice depending on the dimensions of wafer used, desired dimensions for the wear surface and other specific design considerations. The base plate 34 is provided with a reference or straight edge 46 extending upward from the upper surface 38 which forms an alignment surface for the mulitplicity of wafers as they are placed in position. The wafers may have a variety of configurations and as shown they are small and thin in structure. Thus they can be inexpensively manufactured and quickly efficiently assembled to form the wear surface for the foil 20. It has been found that wafers which are two inches long by $\frac{5}{8}$th of an inch wide and $\frac{1}{8}$th of an inch thick work effectively for this purpose. As the wafers are placed in position, they are pushed against previously placed wafers and accordingly, are urged against the straight edge 46 and thus are maintained in tight aligned interengagement. The vacuum applied through openings 36 and chamber 37 assists in retaining this desired multiplicity arrangement. The leading edge 49 of the wafers 40 is beveled to form an edge for the ultimate foil to use in doctoring fluid from the moving wire.

The next step, as shown in FIG. 3, is to apply a predetermined amount of bonding material 47, such as a conventional epoxy, on the upper surface 48 of the wafers 40. The adhesive is carefully metered out in a relatively precise amount so that there is not an excess of adhesive present.

Thereafter, as shown in FIG. 4, the main body portion 50 of the ultimate drainage device is positioned on the adhesive and retained thereon until it is bonded by means of the adhesive to the multiplicity of wafers 40 to complete the drainage foil 20. During the steps of FIGS. 3 and 4, the vacuum is continually applied to assist in holding the wafers in the desired position and pattern. The main body portion 50 has a recess 52 formed on it undersurface terminating in a shoulder 54 inwardly positioned from one edge of the main body portion 50. The pocket or recess 52 forms a reception area for the multiplicity of wafers 40 and shoulder 54 cooperating with straight edge 46 in retaining them in aligned and closely adjacent side by side position. Additionally, recess 52 captures the adhesive on surface 48 and assists in preventing adhesive from being forced outward and away from the multiplicity when main body portion 50 is applied. This prevents the undesirable manufacturing result with adhesive being exposed for contamination of the surrounding area. A shim 47 is provided between the main body portion 50 and the upper surface 38 of the base plate 34 in the area other than the location of the wafers 40 to help maintain bond gap, position and alignment until the bonding is complete.

An effective material for main body portion 50 has been found to be a substrate of fiber glass reinforced resin referred to as resin bonded fiberglass or similar conventional well known substitutes therefor. After the main body portion 50 has been engaged with the adhesive on surface 48 of the multiplicity of wafers, the combination is allowed to stand and cure in accordance with conventional manufacturing procedures.

The danger of pressure forcing epoxy from between the undersurface of the main body portion 50 and the upper surface of the wafers during fabrication is largely avoided since the separation of these members is held constant by shim 47 and the epoxy is applied in recess 52.

It has been found to be effective to provide ceramic or aluminum oxide wafers and main body portion of similar or substantially the same coefficient of thermal expansion. Examples are coefficients of linear thermal expansion per degree Fahrenheit for the wafers and main body portion of $6.8\times10^{-6}$ and $5.2\times10^{-6}$; each of which being within 15% of the mean coefficient of the two.

If the coefficient of thermal expansion of the main body portion is substantially greater than that of the wear resistant wafers, gaps can occur in the wear surface due to separation of the wafers upon temperature rise. Certain amounts of gap separation are acceptable however depending upon web characteristics. Likewise, upon a decrease of temperature, the wafers can be compacted by the contraction of the main body portion which can create undesirable shearing forces in the bond material.

The bond shear strength should be equal to or greater than the shear forces resulting from expansion or contraction.

A three part laminate of the wafers, an epoxy bonding agent, and a resin bonded fiber glass body portion is effective in use as a wear surface on papermaking machinery. In this manner, a means is provided for bonding ceramic to a support substrate for economical use as a long time wear surface.

One successful lamination includes an all Alumina ceramic arrangement of wafer, a two part epoxy adhesive with the commonly known hardener Epotuf, and a resin impregnated fiber glass body portion. Epotuf is a registered trademark of Reichold Chemicals Inc.

FIGS. 8 and 9 illustrate alternate ways of holding the wafers in alignment during fabrication of the drainage device. In both FIGS. the horizontal base plate is designated by the numeral **34*a* and is similar to base plate 34 described above except that the holes 36 and vacuum chamber 37 are omitted. Instead in FIG. 8 an adhesive member 36*a* is used to hold wafers 40*a* in position and in FIG. 9 a magnetic member 36*b* is used to hold the wafers 40*b*** in position. Otherwise the method is the same as described above.

In FIG. 6 an irregularly shaped tongue 51 extends from the side of main body portion 50 opposite to the side containing the wear surface formed by the multiplicity of wafers 40 to facilitate mounting of the foil 20 on a papermaking machine in a conventional manner.

The leading edge of the drainage foil 20 as shown in FIG. 4 includes the combination of edge 53 of main body portion 50 and edge 49 of wafers 40 which are beveled to provide a desirable surface for doctoring water from the moving foil. Also the multiplicity of wafers 40 has a greater height than the depth of recess 52 so that in operating position it projects above the adjacent surface of the main body portion 50 to facilitate its use as the wear surface of the drainage foil. The provision of the recess may not be necessary in all applications. When the recess is employed however its depth must be equal to or less than the bond thickness plus wafer thickness.

When the wear surface is provided in a suction box cover, apertures can be provided in a conventional manner so that when the suction box 26 is mounted in a papermaking machine in the position as shown in FIG. 1, the use of suction can be taken advantage of in working with the box 26 in removing or doctoring water from the material on the wire or web 23.

In use, foil 20 is inverted from the position in which it is assembled in manufacture, as shown in FIG. 6. The multiplicity of wafers 40 form the wear surface as the foil 20 is removed from the upper surface 38 of base plate 34. The foil is then mounted in a conventional manner on the Fourdrinier machine. The multiplicity of wafers formed in the manner described above are thus interconnected in a tight strongly knit fashion so that they cannot be easily displaced during operation of the papermaking machine and when subjected to wear in doctoring fluid and supporting the moving wire.

An alternative form of drainage device or similar wear surface structure is shown in FIG. 7 which is a fragmentary view of the recessed main body portion 50 of the previous embodiment. Located between the main body portion **50*a* and the multiplicity of wafers 40*a* is a scrim 58*a* of a conventional nature, generally a woven substrate, on which the adhesive is applied. The epoxy or other bonding material soaks into the woven substrate or scrim 58***a* which serves to retain the epoxy in position on the surface of wafers 40*a* during fabrication so that the main body portion 50*a* will be bonded tightly to the wafers with the scrim captured therebetween. In this manner the epoxy is controlled so that it is not forced from between the adjoining surfaces when the foil 50*a* is applied. The foil 20*a* of FIG. 7 is fabricated in the same inverted position as in the earlier embodiment. It is then removed from the forming base 34*a* and mounted in a conventional manner in a papermaking machine.

This can be used in all applications of drainage devices including foils, suction boxes. Other similar types of wear surfaces which are used in similar environments can also be manufactured in the same manner with the same effective ultimate results.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A drainage device adopted to be mounted on a papermaking machine under a moving web and positioned to support the web and to engage the undersurface of the web as it passes thereover to extract fluid downwardly from the web, the drainage device comprising; a main body portion, a multiplicity of wear resistant wafers, said main body portion and said wafers having substantially the same coefficient of thermal expansion, a bonding material affixing said wafers on the main body portion with the upper surface of the wafers forming a wear surface and an extraction surface for doctoring fluid from the moving web as it passes over said drainage device, and in which said wafers are rectangular and aligned in a multiplicity of rows.

2. A drainage adopted to be mounted on a papermaking machine under a moving web and positioned to support the web and to engage the undersurface of the web as it passes thereover to extract fluid downwardly from the web, the drainage device comprising; a main body portion, a multiplicity of wear resistant wafers, said main body portion and said wafers having substantially the same coefficient of thermal expansion, a bonding material affixing said wafers on the main body portion with the upper surface of the wafers forming a wear surface and an extraction surface for doctoring fluid from the moving web as it passes over said drainage device, and in which said wafers are rectangular and aligned in rows with the wafers in each adjacent row being offset with respect to the wafers in the next adjacent row.

3. A drainage device adopted to be mounted on a papermaking machine under a moving web and positioned to support the web and to engage the undersurface of the web as it passes thereover to extract fluid downwardly from the web, the drainage device comprising; a main body portion, a multiplicity of wear resistant wafers, said main body portion and said wafers having substantially the same coefficient of thermal expansion,, a bonding material affixing said wafers on the main body portion with the upper surface of the wafers forming a wear surface and an extraction surface for doctoring fluid from the moving web as it passes over said drainage device, and in which said wafers are rectangular and wherein each wafer is approximately 2 inches in length, $\frac{5}{8}$ inches wide and $\frac{1}{8}$ of an inch thick.

4. A drainage device adopted to be mounted on a papermaking machine under a moving web and positioned to support the web and to engage the undersurface of the web as it passes thereover to extract fluid downwardly from the web, the drainage device comprising; a main body portion, a multiplicity of wear resistant wafers, said main body portion and said wafers having substantially the same coefficient of thermal expansion, a bonding material affixing said wafers on the main body portion with the upper surface of the wafers forming a wear surface and an extraction surface for doctoring fluid from the moving web as it passes over said drainage device, and wherein a substrate of scrim material is affixed between the main body portion and the wafers.

* * * * *